US007381080B1

(12) United States Patent
Lai

(10) Patent No.: US 7,381,080 B1
(45) Date of Patent: Jun. 3, 2008

(54) ELECTRICAL CORD RETENTION DEVICE

(76) Inventor: Wen-Cheng Lai, A1, 12F, No. 129, Sec. 1, Hsin-Nan Rd., Nan-Chien Village, Lu-Chu Country, Taoyuan Hsien (TW)

( * ) Notice: Subject to any disclaimer, the term of this patent is extended or adjusted under 35 U.S.C. 154(b) by 0 days.

(21) Appl. No.: 11/850,149

(22) Filed: Sep. 5, 2007

(51) Int. Cl.
*H01R 13/62* (2006.01)

(52) U.S. Cl. ..... 439/369

(58) Field of Classification Search ..... 439/369, 439/414, 404, 449, 409, 419, 226, 356, 459, 439/280, 345, 296, 389, 387; 362/656, 391, 362/396

See application file for complete search history.

(56) References Cited

U.S. PATENT DOCUMENTS 4,529,258 A * 7/1985 Anthony ..... 439/142
4,874,329 A * 10/1989 Yu ..... 439/409
6,830,473 B2 * 12/2004 Trainello ..... 439/416

* cited by examiner

*Primary Examiner*—Edwin A. León
(74) *Attorney, Agent, or Firm*—Rabin & Berdo, P.C.

(57) ABSTRACT

An electric cord retention device includes a base, at least one cord hold-down member, and at least one lid, which together receive and retain an electric cord. The base has a top forming a cord accommodation slot and a coupling portion. Two conductor pieces are received and fixed in the cord accommodation slot and has sharp tips located in the cord accommodation slot. The coupling portion is arranged adjacent to the cord accommodation slot. The cord is positioned in the cord accommodation slot and is depressed down by the cord hold-down member that is fit into the cord accommodation slot and positioned above the cord. The lid is tightened to the coupling portion by means of threading engagement, whereby rotation of the lid with respect to the coupling portion causes the cord hold-down member to move downward and apply a force to the cord against the sharp tips, making the sharp tips piercing into the cord to establish electric connection therebetween.

13 Claims, 10 Drawing Sheets

ELECTRICAL CORD RETENTION DEVICE

BACKGROUND OF THE INVENTION

1. Field of the Invention

The present invention relates to a device for connecting and retaining an electric cord, and in particular to a device that realizes electric connection with an electric cord without additional tools/jigs and that is applicable to bulb sockets and electric controllers.

2. The Related Arts

Lighting strings are widely used in various celebrations/holidays and events/festivals/meetings, where the lighting strings are for example hung on trees or building or even transportation vehicles to enhance pleasure atmosphere by the lighting effect provided by the lighting strings.

A lighting string comprises a plurality of light bulbs or lighting elements, which each connected with an electric cord to receive electric power from an external source for lighting. The conventional ways of connecting the light bulb to the electric cord has the following general disadvantages:

(1) The bulb is directly fixed to the cord, often in a serial connection, so that when one of the bulbs of a lighting string is broken, the bulbs that are located behinds the broken bulb cannot receive electric power and cannot be lit; and in addition mounting and removing the bulb to/from the cord is difficult.

(2) The distance between adjacent bulbs is fixed and there is no way that a user may adjust the distance by himself or herself to suit for different applications.

Another known way of connecting a bulb to an electric cord is first using a jig or tool to mount a bulb socket to the electric cord and form electric connection between terminals of the socket and the cord. This known way is of the advantages of easy and efficient manufacturing and assembling, but still suffers some disadvantages:

(1) Mounting the bulb socket to the cord requires jigs/tools operated by experienced workers so that manufacturing is subjected to the limitation of site and experienced operators, thereby being less flexible in manufacturing.

(2) The bulb socket, once mounted to the electric cord, cannot be easily dismounted or dismounting may easily cause damage to the lighting string or the cord, leading to failure of operation of the lighting string.

(3) The distance between adjacent sockets is usually set fixed and a user is not allowed adjust the distance by himself/herself so that the lighting string with such bulb sockets cannot suit for different applications.

On the other hand, the lighting string is only lit in the nighttime or during the period of festivals and is not continuously lit for 24 hours a day. Thus, a controller is often employed to control the lighting of the lighting string. The controller connects the lighting string to an external power source. The controller, although operable in timely controlling lighting of the lighting string, has drawbacks:

(1) Assembling of the controller and connection of the controller with electric cords are carried out by experienced workers and special tools/jigs may be needed, both making the manufacturing time- and labor-consuming.

(2) The controller includes a circuit board carrying control circuits and the circuit board is connected to electric cords/wires by soldering, which, once again, making the manufacturing very time-consuming and reducing the passing rate of product.

SUMMARY OF THE INVENTION

In view of the above problems of the conventional lighting strings and electric controller, the present invention is aimed to overcome the problems, especially the connection of a bulb socket or the controller to an electric cord, in order to provide solutions to the problems of adjustment of distance between bulbs in a lighting string, being difficult to dismount once mounted, and problems associated with tools/jigs, sites, experienced operators that are required in mounting/dismounting operation.

Thus, in accordance with the present invention, an electric cord retention device is provided, comprising a base, at least one cord hold-down member, and at least one lid, which together receive and retain an electric cord. The base has a top forming a cord accommodation slot and a coupling portion. Two conductor pieces are received and fixed in the cord accommodation slot and has sharp tips located in the cord accommodation slot. The coupling portion is arranged adjacent to the cord accommodation slot and extends from the top of the base. The cord is positioned in the cord accommodation slot and is depressed down by the cord hold-down member that is fit into the cord accommodation slot and positioned above the cord. The lid is tightened to the coupling portion by means of threading engagement, whereby rotation of the lid with respect to the coupling portion causes the cord hold-down member to move downward and apply a force to the cord against the sharp tips, making the sharp tips piercing into the cord to establish electric connection therebetween.

The electric cord retention device can be applied in a bulb socket, wherein a lower portion of the base forms a cavity to serve as a socket for receiving and retaining an electric bulb in a rotary manner.

The electric cord retention device of the present invention can also be applied in an electric controller, wherein the controller comprises a housing, at least two cord hold-down members, at least two electric cords, and at least two lids. The housing is delimited by a side wall formed by a lower portion of the base and having an opening covered by a top portion. The bottom portion forms an interior space receiving therein a circuit board that forms at least two sets of insertion holes, each insertion hole set including at least two insertion holes. The circuit board also forms control circuits thereon. The top portion forms at least two cord accommodation slots and at least two coupling portions, each cord accommodation slot receiving and retaining two conductor pieces, each conductor piece having a first end forming a sharp tip extending into the respective cord accommodation slot and an opposite second end forming an insertion terminal extending into the interior space and fit into the respective insertion hole of the circuit board to form electric connection therewith. The coupling portions are respectively arranged adjacent to the cord accommodation slots and extend from the top of the top portion. End sections of the electric cords are received in the cord accommodation slots. A top end of each cord hold-down member projects beyond a top end of the respective coupling portion. The lid is tightened to the coupling portion by threading engagement to cause the sharp tips of the conductor pieces in each cord accommodation slot to pierce through insulation of the cord and to get in contact with conductors of the cord for establishing electric connection therebetween.

The present invention is effective in providing an electric cord retention device that uses a rotary lid and threading engagement that gradually tightens the lid to apply a force to the cord hold-down member that in turn applies the force to the cord to cause the sharp tips of the contact pieces to piece through the insulation of the cord and forming electric connection with the conductors of the cord, thereby realizing a simple and tool-free mounting/dismounting operation.

The present invention is also effective in providing an electric cord retention device that can be assembled in any location without any experienced operator so that the manufacturing cost can be reduced.

The present invention is further effective in providing an electric cord retention device that can be mounted/dismounted without using jigs/tools and can be done by general consumers so that the device can be sold as a DIY (do-it-yourselves) kit to be used with a lighting string and a user may arrange the distance between bulbs as desired.

The present invention is also effective in providing an electric controller that allows changes/modifications of a control circuit board accommodated therein to allow a user to set various lighting modes, including timer setting, remote control, and setting of frequency of flashing to realize fully automatic control.

The present invention is also effective in providing an electric controller, which can be manufactured/assembled without any tools or jigs thereby simplifying the manufacturing process and enhancing passing rate of products.

The present invention will become more obvious from the following description when taken in connection with the accompanying drawings, which show, for purposes of illustration only, preferred embodiments in accordance with the present invention. In the drawings:

DETAILED DESCRIPTION OF THE PREFERRED EMBODIMENTS

Figure 1:
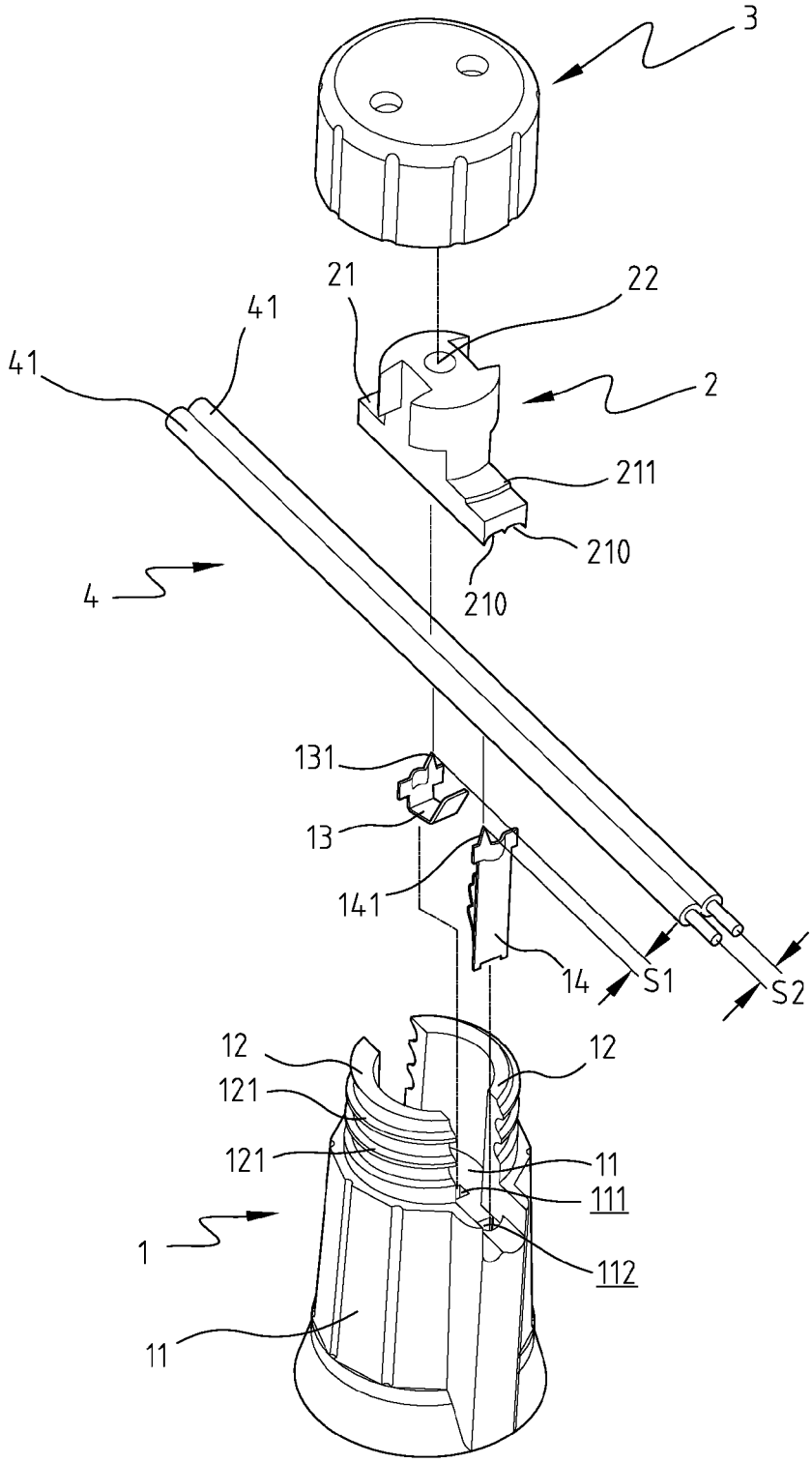
FIG. 1 is a perspective view of an electric cord retention device constructed in accordance with a first embodiment of the present invention in an exploded form.
Figure 2:
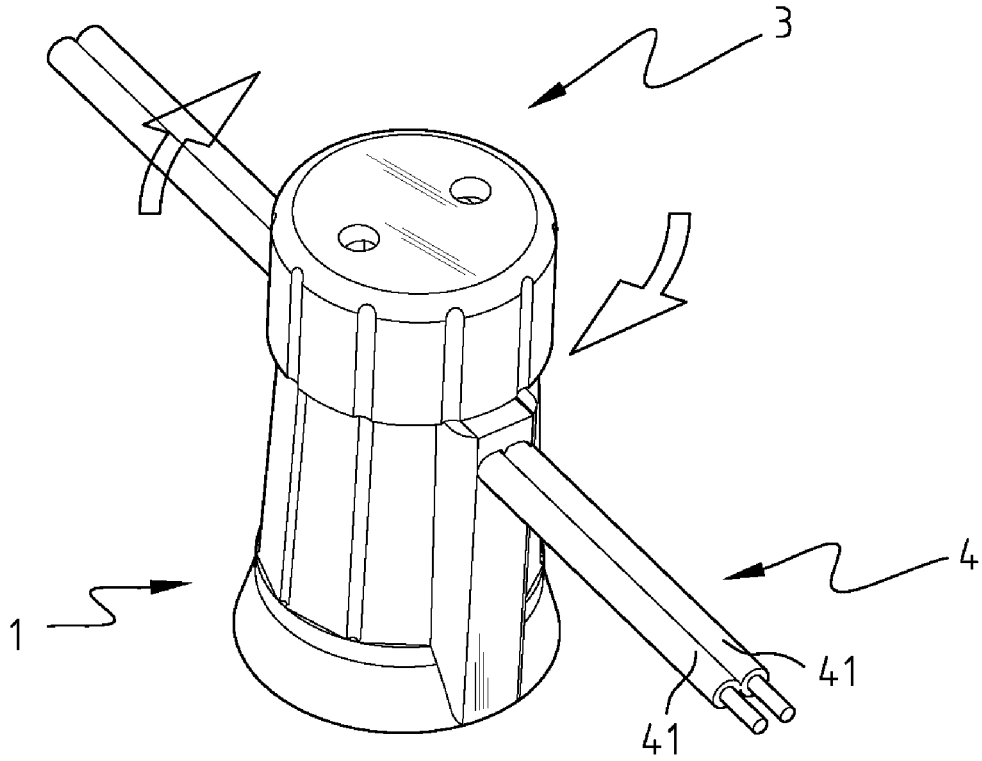
FIG. 2 is a perspective view of the electric cord retention device of the first embodiment of the present invention, in an assembled form.
Figure 3:
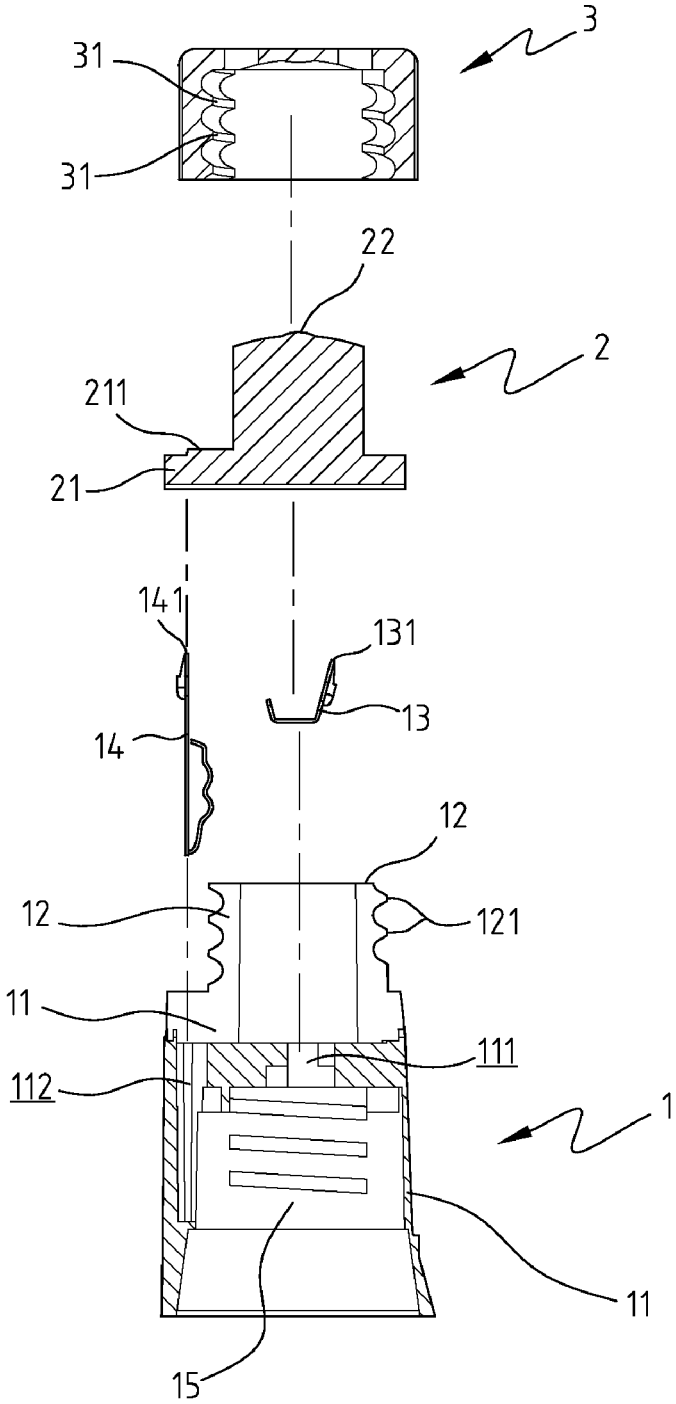
FIG. 3 is a cross-sectional view of the electric cord retention device of the first embodiment of the present invention, in an exploded form.

With reference to the drawings and in particular to FIGS. 1-3, which are, respectively, an exploded view, a perspective view in assembled form, and a cross-sectional view in exploded form of an electric cord retention device constructed in accordance with the present invention, the electric cord retention device of the present invention comprises a base 1, a cord hold-down member 2, and a lid 3, which together function to retain and establish electric connection with an electric cord 4.

The base 1 has an upper portion forming a slot 11, serving to partially accommodating the electric cord 4 therein 3, and a coupling portion 12. Mounted inside the cord accommodation slot 11 are two conductor pieces 13, 14, each having an end extending into a lower portion of the base 1 and an opposite end forming a sharp tip 131, 141, respectively. The sharp tips 131, 141, when assembled in the base 1, extend into the cord accommodation slot 11 and at substantially the same altitude inside the cord accommodation slot 11, but are spaced by a distance S1, which is substantially corresponding to the distance S2 between two conductors contained inside the electric cord 4. In the embodiment illustrated, the conductor piece 13 is received and retained in a central opening 111 defined in a bottom of the cord accommodation slot 11 with a lower section of the conductor piece 13 extending into the lower portion of the base 1 and the sharp tip 131 that is formed in an opposite upper section of the conductor piece 13 extending into and located at a middle portion of the cord accommodation slot 11. The conductor piece 14 is received and retained in a side opening 112 defined in the bottom of the cord accommodation slot 11 with a lower section of the conductor piece 14 extending into the lower portion of the base 11 and positioned along an inside surface of a circumferential wall of the lower portion of the base 11 and the sharp tip 141 that is formed in an opposite upper section of the conductor piece 14 extending into and located at a side portion of the cord accommodation slot 11. The coupling portion 12 is arranged along opposite sides of the cord accommodation slot 11 and extends from a top of the base 1. External threading 121 is formed an outside surface of the coupling portion 12. In the embodiment illustrated, the coupling potion 12 is composed of two semi-circular plates arranged along opposite sides of the cord accommodation slot 11 respectively.

The cord hold-down member 2 is configured to correspond, in shape and size, to the cord accommodation slot 11 of the base 1. The cord hold-down member 2 has a bottom forming a cord retention plate 21 having a bottom face in which two extended recesses 210 are formed and correspond in shape and size to two insulation jackets 41 of the electric cord 4 for partially fitting over and enclosing the insulation jackets 41. In the embodiment illustrated, the cord retention plate 21 extends sideways beyond the cord hold-down member 2. A raised portion 211 is formed on a top face of one of the sideway extensions of the cord retention plate 21 at a location corresponding to the sharp tip 141 of the second conductor piece 14

The lid 3 has a circumferential wall that has an inside surface complementary in shape to the top end of the coupling portion 12 of the base 1. In the embodiment illustrated, the lid 3 forms, on the inside surface of the circumferential wall thereof, internal threading 31 matingly engageable with the external threading 121 of the coupling portion 12.

Figure 4:
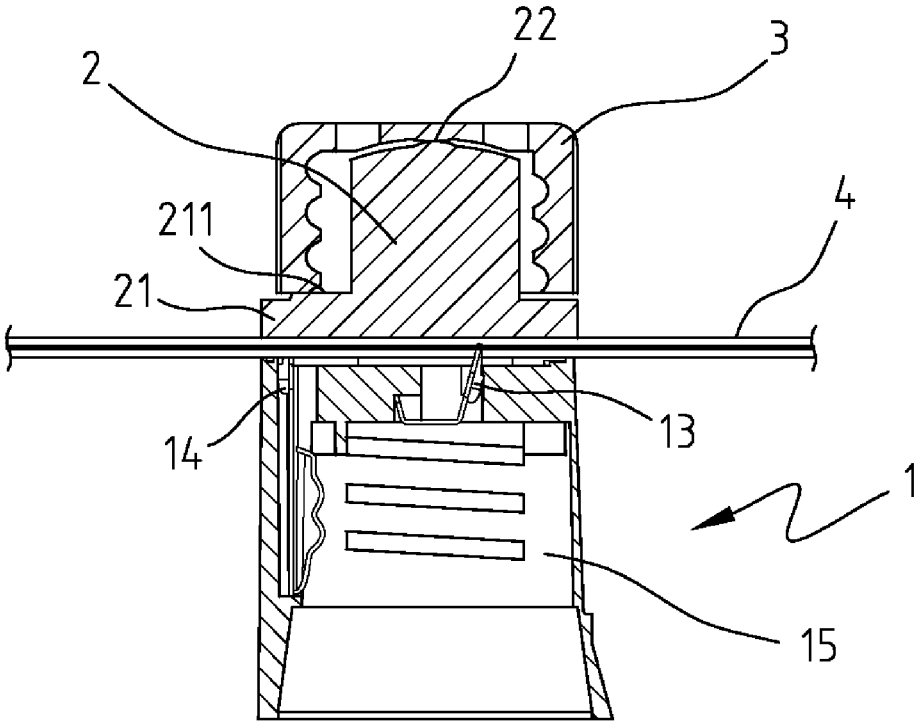
FIG. 4 is a cross-sectional view of the electric cord retention device of the first embodiment of the present invention, in an assembled form, showing sharp tips of conductor pieces of the electric cord retention device piercing through insulation of an electric cord.

As shown in FIG. 4, to assemble, the electric cord 4 is first put in the cord accommodation slot 11 of the base 1 and the cord hold-down member 2 is then fit into the cord accommodation slot 11 with the recesses 210 on the bottom face thereof partially fit over the insulation jackets 41 of the electric cord 4. The threading 31 of the lid 3 engages the threading 121 of the coupling portion 12 and the lid 3 is rotated to secure to the coupling portion 12. Due to the threading engagement, the rotation of the lid 3 causes the lid 3 to move downward, toward the base 1. The lid 3 thus abuts against and drives the cord hold-down member 2 downward and the cord retention plate 21 of the cord hold-down member 2 in turn depresses the cord 4 downward against the conductor pieces 13, 14 to have the sharp tips 131, 141 of the conductor pieces 13, 14 pierce through the insulation jackets 41 of the electric cord 40 to get in contact with the conductors inside the cord 4.

Figure 5:
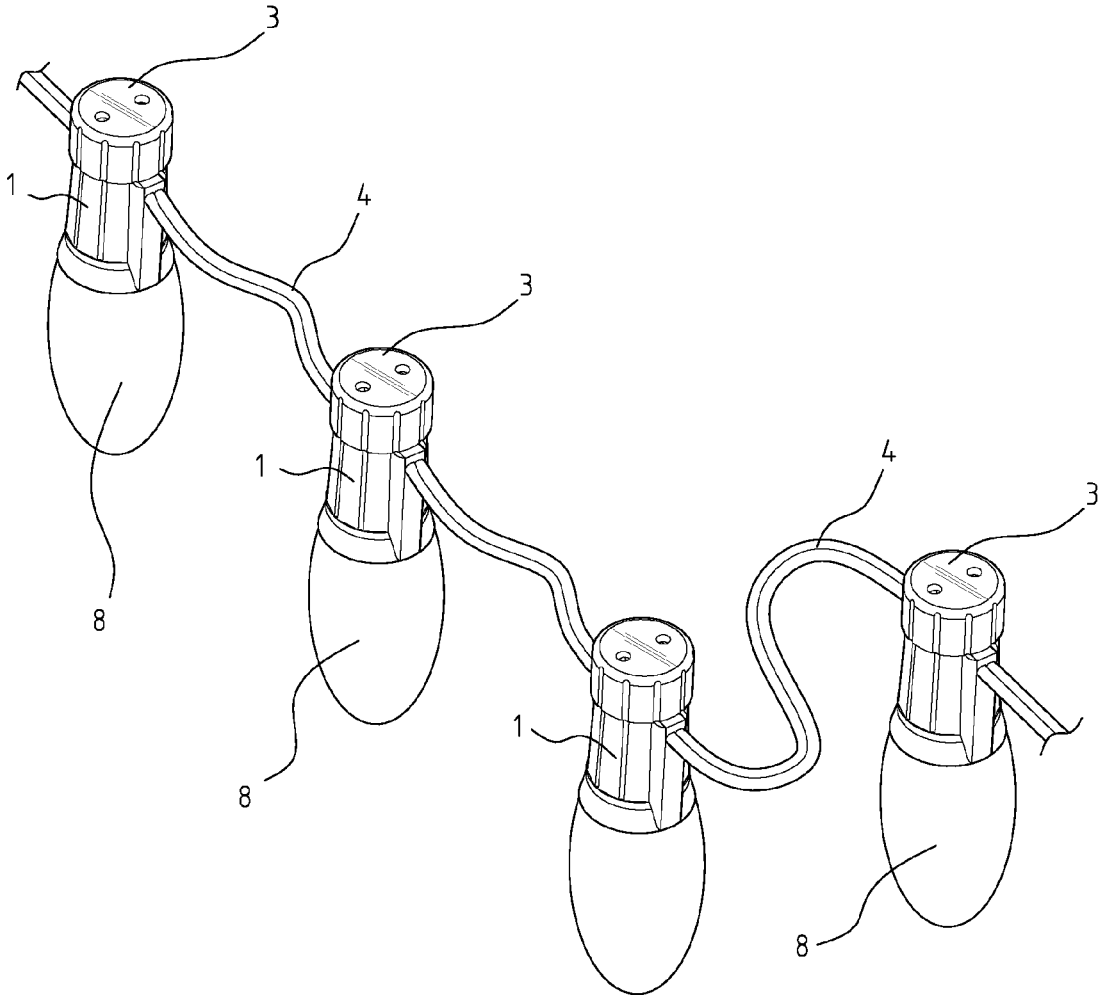
FIG. 5 is a perspective view illustrating an application of the electric cord retention device in accordance with the first embodiment of the present invention.
Figure 6:
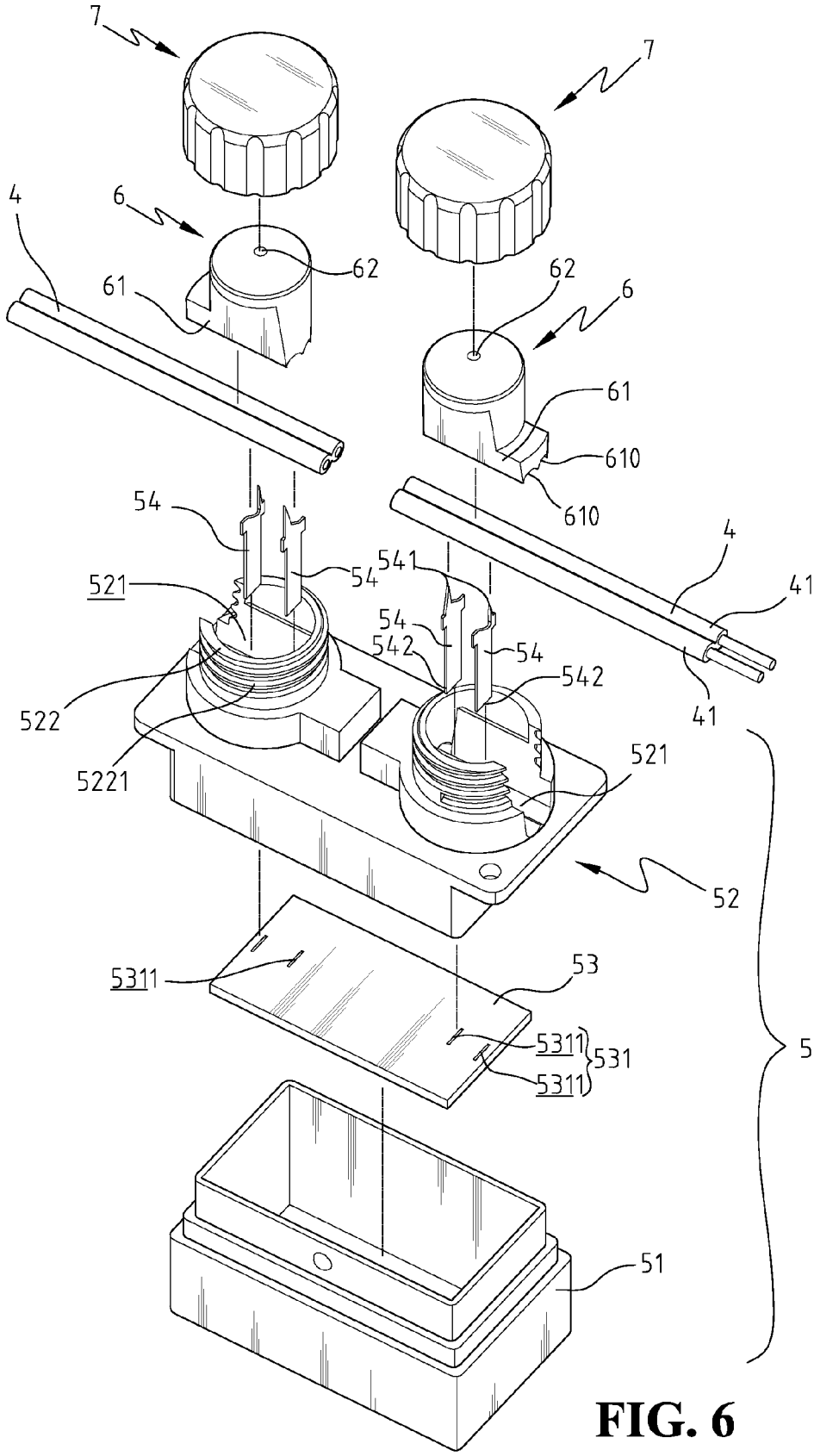
FIG. 6 is a perspective view of an electric cord retention device constructed in accordance with a second embodiment of the present invention in an exploded form.
Figure 7:
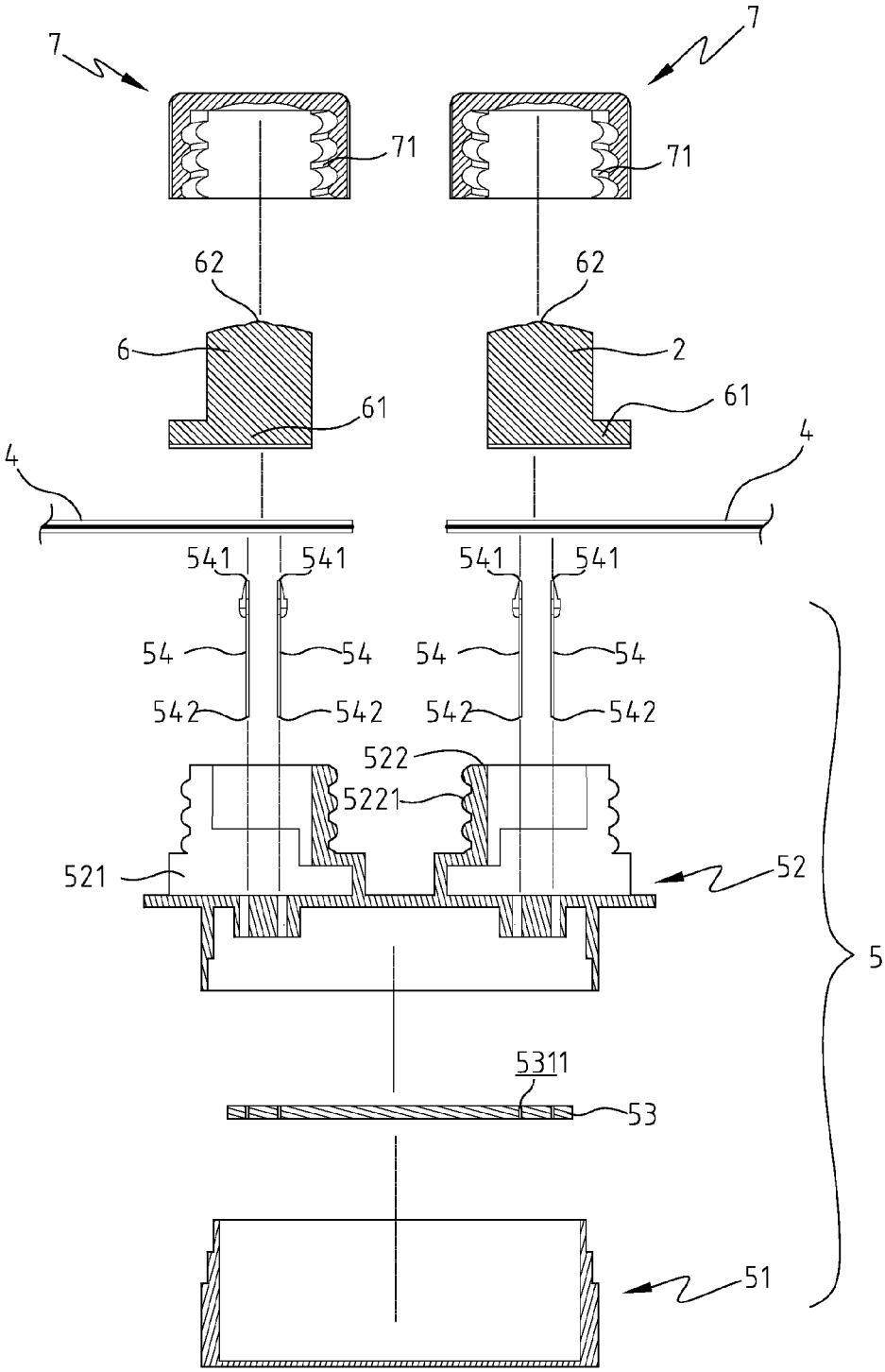
FIG. 7 is a cross-sectional view of the electric cord retention device of the second embodiment of the present invention, in an exploded form.
Figure 8:
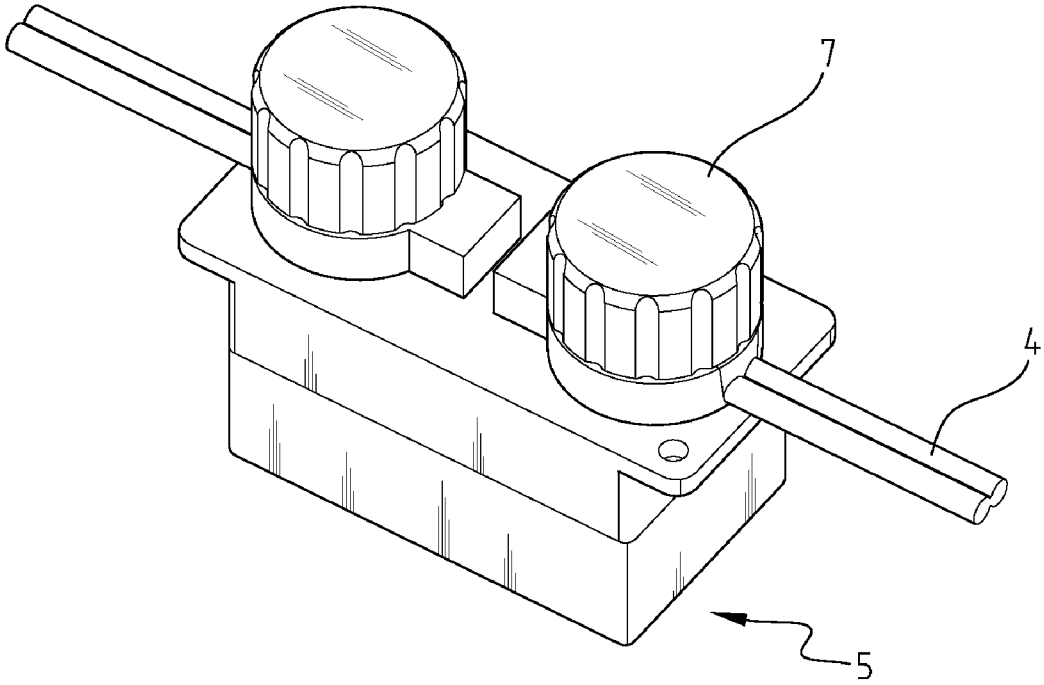
FIG. 8 is a perspective view of the electric cord retention device of the second embodiment of the present invention, in an assembled form.

The electric cord retention device of the present invention is applicable to various electrical appliances that require connection with an electric cord. In the embodiment illustrated, the electric cord retention device is formed with a bulb socket and accordingly, the upper portion of the base 1 forms the electric cord retention device, while the lower portion of the base 1 forms the bulb socket. Thus, a bulb receiving cavity 15, as shown in FIGS. 3 and 4, is formed in the lower portion of the base 1 to serve as the bulb socket. The lower sections of the conductor pieces 13, 14 extend into the bulb socket 15. A bulb 8, see FIG. 8, is receivable in the bulb socket 15 and in physical engagement with the conductor pieces 13, 14 to establish electric connection between the bulb 8 and the electric cord 4 for powering the bulb 8. In an application illustrated in FIG. 5, a number of bulbs 8 are electrically connected to the electrical cord 4 by the same number of bulb sockets 15 each formed in one electric cord retention device of the present invention.

Referring to FIG. 4, in accordance with the present invention, when the lid 3 is rotatably tightened to the base 1, the lid 3 gets into contact with and applies an intensified force to the boss 22 formed on the top end of the cord hold-down member 2. Since the boss 22 is set at a point of the cord hold-down member 2 that substantially corresponds in location to the first conductor piece 13 so that the intensified force applied to the boss 22 enhances the penetration of the sharp tip 131 of the conductor piece 13 through the associated insulation jacket 41 of the electric cord 4 to establish electric engagement between the conductor piece 13 and the associated conductor of the cord 4. Similarly, when the lid 3 is rotatably tightened to the coupling portion 12 of the base 1, an intensified force is applied to another point of the cord hold-down member 2 (the raised portion 211 of the cord retention plate 21 of the cord hold-down member 2) that corresponds to the second conductor piece 14 so that the intensified force applied to the raised portion 211 enhances the penetration of the sharp tip 141 of the conductor piece 14 through the associated insulation jacket 41 of the electric cord 4 to establish electric engagement between the conductor piece 14 and the associated conductor of the cord 4.

To remove the electric cord retention device, the lid 3 is rotated in a reversed direction to release from the coupling portion 12 of the base 1. The cord hold-down member 2 is then removed out of the cord accommodation slot 11, followed by removal of the cord 4 out of the slot 11. No additional tool or jig is needed in mounting/removal of the electric cord retention device.

With reference to FIGS. 6-9, which illustrate, respectively, an exploded perspective view, a cross-sectional view in exploded form, a perspective view, and a cross-sectional view in assembled form of an electric cord retention device in accordance with a second embodiment of the present invention, the second-embodiment electric cord retention device is applied to an electric controller, which comprises a housing 5, at least two cord hold-down members 6, and at least two lids 7 for retaining and establishing electrical connection with two electric cords 4.

The housing 5 comprises a bottom portion 51 and a top portion 52. The bottom portion 51 of the housing 5 forms an interior space having a top opening and a circuit board 53 is received and fixed in the interior space of the bottom potion 51. The circuit board 53 is provided with at least two sets of insertion holes 531, each insertion hole set 531 including two insertion holes 5311. The circuit board 53 is further provided with control circuits providing various control functions, such as timer settings for switching ON/OF, remote controlling, schedule setting, and various flashing/lighting modes, including frequency of flashing and interruption of flashing. The top portion 52 has a bottom forming a receptacle opening for fitting over the opening top end of the bottom portion 51 to form the housing 5. Formed on a top face of the top portion 52 are at least two cord accommodation slots 521 and at least two coupling portions 522. Each cord accommodation slot 521 receive and retain therein two conductor pieces 54, each of which has a sharp tip 541 extending into the associated cord accommodation slot 521 and an opposite end forming an insertion terminal 542 that extends into the interior space of the bottom portion 51 to fit into an associated one of the insertion holes 5311 of the circuit board 53 to form electric connection therewith. The coupling portions 522 are arranged along opposite sides of the cord accommodation slots 521 and extend from the top face of the top portion 52. In the embodiment illustrated, the coupling potions 522 are each in the form of a cylinder with a notch formed in the cylindrical wall. External threading 52221 is formed an outside surface of the cylinder of each coupling portion 522.

The cord hold-down members 6 are configured to correspond, in shape and size, to the respective cord accommodation slots 521 of the top portion 52 and, in the embodiment illustrated, are respectively received in the cord accommodation slots 521. Each cord hold-down member 6 has a bottom forming a cord retention plate 61 having a bottom face in which two extended recesses 610 are formed and correspond in shape and size to two insulation jackets 41 of the associated electric cord 4 for partially fitting over and enclosing the insulation jackets 41. In the embodiment illustrated, a top end of the cord hold-down member 6 projects beyond a top end of the associated coupling portion 522.

Each lid 7 has a circumferential wall that is complementary in shape to the top end of the associated coupling portion 522 of the top portion 52. In the embodiment illustrated, the lid 7 forms, on an inside surface of the circumferential wall thereof, internal threading 71 matingly engageable with the external threading 5221 of the associated coupling portion 522.

Figure 9:
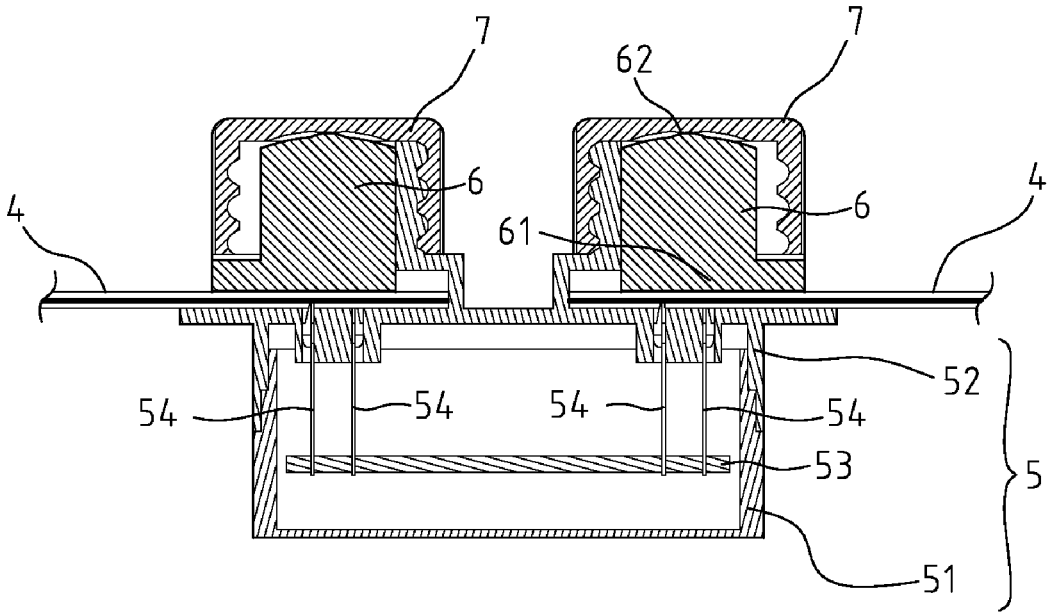
FIG. 9 is a cross-sectional view of the electric cord retention device of the second embodiment of the present invention, in an assembled form.

Referring to FIG. 9, to assemble, end sections of the electric cord 4*s* are first put in the cord accommodation slot 521 of the top portion 52, respectively, and the cord hold-down members 6 are then fit into the cord accommodation slots 521 with the recesses 610 on the bottom faces thereof partially fit over the insulation jackets 41 of the respective electric cords 4. The threading 71 of each lid 7 engages the threading 5221 of the respective coupling portion 532 and the lid 7 is rotated to secure to the coupling portion 522. Due to the threading engagement, the rotation of the lid 7 causes the lid 7 to move downward and thus abutting against and driving the cord hold-down member 6 downward. The cord retention plate 61 of the cord hold-down member 6 in turn depresses the cord 4 downward against the conductor pieces 54 to have the sharp tips 541 of the conductor pieces 54 pierce through the insulation jackets 41 of the electric cord 40 to get in contact with the conductors inside the cord 4. The insertion terminals 542 of the conductor pieces 54 extend into the interior space of the bottom portion 51 and are further inserted into the insertion holes 5311 of the circuit board 53 to form electrical connection with circuits on the circuit board 53 to realize various control function, including timer setting, remote control, and flashing control.

Figure 10:
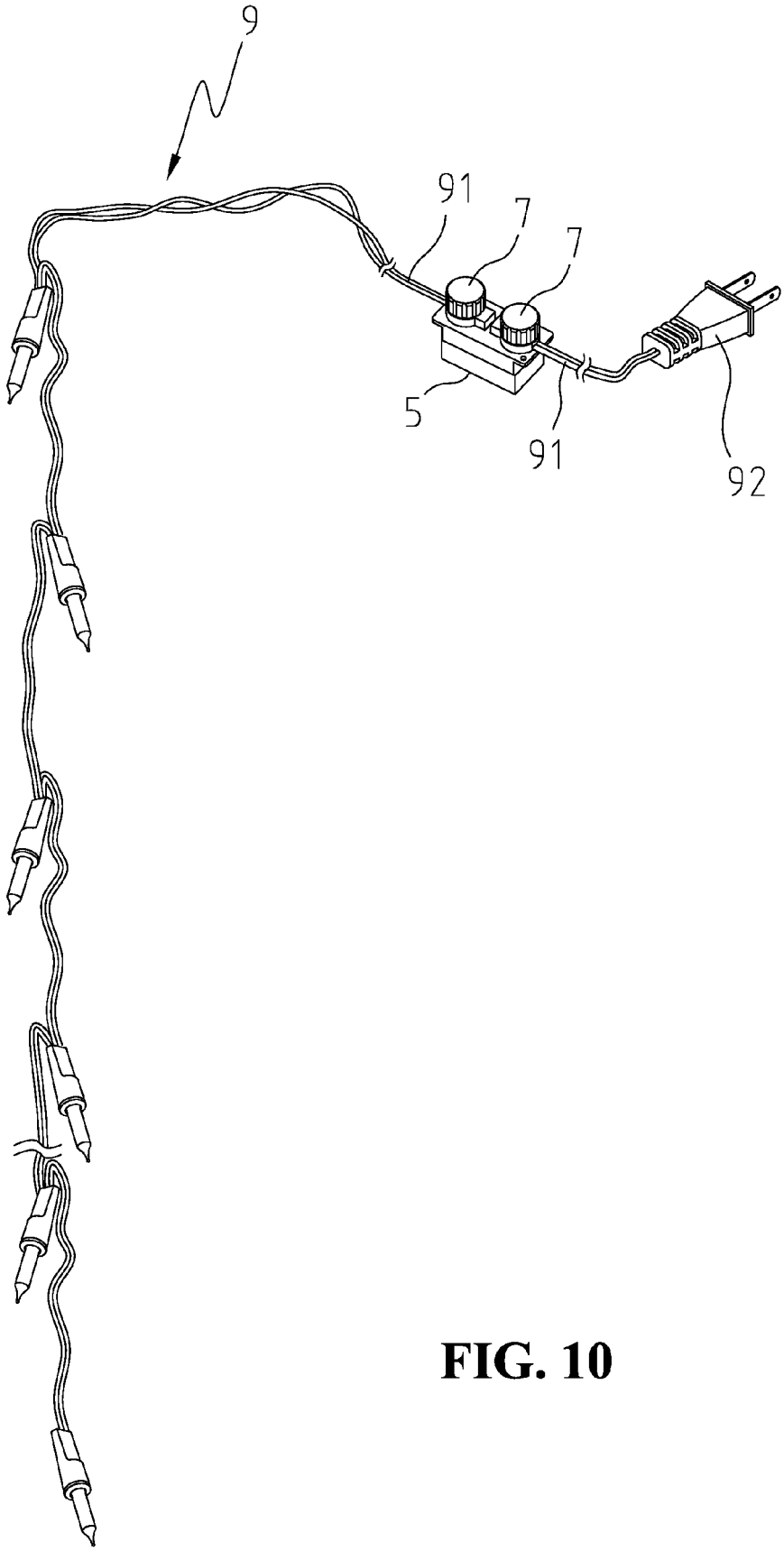
FIG. 10 is a perspective view illustrating an application of the electric cord retention device in accordance with the second embodiment of the present invention.

Referring to FIG. 10, which illustrates an application where the electric controller that was just described is combined with a lighting string 9 comprising an electric cord 91 with lamps attached thereto. The cord 91 is cut into two sections, one carrying the lamps and the other carrying for example a plug 92. The two sections of the cord 91 are then connected to the housing 5 of the electric controller in the same way as that described above. Thus, when the plug 92 is put into for example a wall socket, electric power is supplied to the lighting string 9 under the control of the circuit board 3 of the controller. In this way, the lighting string 9 can be controlled to light in various modes by the circuit board 5.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An electric cord retention device comprising:

a base forming a cord accommodation slot and a coupling portion, the cord accommodation slot being defined in a top of the base and receiving and retaining there first and second conductor pieces, each having a first end forming a sharp tip extending into the cord accommodation slot and an opposite end extending into a cavity defined in the base, the coupling portion being arranged adjacent the cord accommodation slot and extending from the top of the base, the coupling portion having an outer face forming external threading;

at least one cord hold-down member corresponding in shape and size to the cord accommodation slot and being receivable in the cord accommodation slot; and at least one lid having a circumferential wall having an inside surface forming internal threading engageable the external threading of the coupling portion to mount the lid to the coupling portion of the base; and wherein the cord accommodation slot is adapted to receive an electric cord having a central conductor enclosed by an insulation jacket, and the cord hold-down member is further received in the cord accommodation slot above the cord so that when the lid is rotatably tightened to the coupling portion, a force is applied through the cord hold-down member to the cord against the sharp tips of the conductor pieces to cause the sharp tips to pierce through the insulation and contact the central conductor of the cord.

2. The electric cord retention device as claimed in claim 1, wherein the cord hold-down member has a top end forming a boss that corresponds in position to the sharp tip of the first conductor piece.

3. The electric cord retention device as claimed in claim 1, wherein the coupling portion comprises two arc plates arrange on opposite sides of the cord accommodation slot.

4. The electric cord retention device as claimed in claim 1, wherein the base has a lower portion forming a bulb socket.

5. The electric cord retention device as claimed in claim 1, wherein the cord hold-down member has a top end projecting beyond a top end of the coupling portion and a bottom forming a cord retention plate.

6. The electric cord retention device as claimed in claim 5, wherein the cod retention plate has a bottom surface forming recesses for partially fitting over two insulation jackets of the cord.

7. The electric cord retention device as claimed in claim 5, wherein the cord retention plate projects sideways beyond the cord hold-down member and forming at least one sideway extension, the extension having a top face forming a raised portion corresponding in position to the sharp tip of the second conductor piece.

8. The electrical cord retention device as claimed in claim 1, wherein the base has a lower portion forming an electric controller.

9. The electric cord retention device as claimed in claim 8, wherein the electric controller comprises a housing that is delimited by a side wall formed by the lower portion of the base and having an opening covered by a top portion, the bottom portion forming an interior space receiving therein a circuit board that forms at least two sets of insertion holes, each insertion hole set including at least two insertion holes, the circuit board forming control circuits thereon, the top portion forming at least two cord accommodation slots and at least two coupling portions, each cord accommodation slot receiving and retaining two conductor pieces, each conductor piece having a first end forming a sharp tip extending into the respective cord accommodation slot and an opposite second end forming an insertion terminal extending into the interior space and fit into the respective insertion hole of the circuit board to form electric connection therewith; the coupling portions being respectively arranged adjacent to the cord accommodation slots and each forming external threading; each cord hold-down member being configured to correspond to the cord accommodation slot and received in the cord accommodation slot; each lid having an inside surface forming internal threading engageable with the external threading of the coupling portion to mount the lid to the coupling portion; wherein each cord accommodation slot is adapted to receive an end of an electric cord with the cord hold-down member received in the cord accommodation slot and positioned on the electric cord so that when the lid is tightened to the coupling portion by threading engagement, the lid applies a force to the cord to cause the sharp tips of the conductor pieces to pierce through the insulation jacket and contact the central conductor of the cord.

10. The electric cord retention device as claimed in claim 9, wherein the cord hold-down member has a top end projecting beyond a top end of the coupling portion.

11. The electric cord retention device as claimed in claim 9, wherein each coupling portion comprises a cylinder having a side wall in which a notch is defined.

12. The electric cord retention device as claimed in claim 9, wherein the cod hold-down member has a bottom forming a retention plate that has a bottom surface forming recesses for partially fitting over two insulation jackets of the cord.

13. The electric cord retention device as claimed in claim 9, wherein the cord hold-down member has a top end forming a boss that corresponds in position to the sharp tip of one of the conductor pieces.

* * * * *